US006651041B1

(12) United States Patent
Juric

(10) Patent No.: US 6,651,041 B1
(45) Date of Patent: Nov. 18, 2003

(54) METHOD FOR EXECUTING AUTOMATIC EVALUATION OF TRANSMISSION QUALITY OF AUDIO SIGNALS USING SOURCE/ RECEIVED-SIGNAL SPECTRAL COVARIANCE

(75) Inventor: Pero Juric, Bellach (CH)

(73) Assignee: Ascom AG, Bern (CH)

( * ) Notice: Subject to any disclaimer, the term of this patent is extended or adjusted under 35 U.S.C. 154(b) by 0 days.

(21) Appl. No.: 09/720,373

(22) PCT Filed: Jun. 21, 1999

(86) PCT No.: PCT/CH99/00269

§ 371 (c)(1),
(2), (4) Date: Feb. 9, 2001

(87) PCT Pub. No.: WO00/00962

PCT Pub. Date: Jan. 6, 2000

(30) Foreign Application Priority Data

Jun. 26, 1998 (EP) ..... 98810589

(51) Int. Cl.[7] ..... G10L 11/00; G10L 11/02
(52) U.S. Cl. ..... 704/228; 704/206; 704/210
(58) Field of Search ..... 704/206, 210, 704/228

(56) References Cited

U.S. PATENT DOCUMENTS 4,860,360 A 8/1989 Boggs
5,794,188 A * 8/1998 Hollier ..... 704/228
6,092,040 A * 7/2000 Voran ..... 704/228
6,427,133 B1 * 7/2002 Paping et al. ..... 704/201

OTHER PUBLICATIONS

Wang, IEEE Journal on Selected Area in Communications, vol. 10, No. 5, pp. 819–829 (1992).
Lam et al., Proceedings of the Int'l Conference on Acoustics, Speech & Signal Processing, vol. 1, pp. 277–280 (1995).
Hansen et al., Journal of the Acoustical Society of America, vol. 97, No. 1, pp. 609–627 (1995).

* cited by examiner

*Primary Examiner*—Talivaldis Ivars Smits
(74) *Attorney, Agent, or Firm*—Birch, Stewart, Kolasch & Birch, LLP

(57) ABSTRACT

A source signal (e.g. a speech sample) is processed or transmitted by a speech coder 1 and converted into a reception signal (coded speech signal). The source and reception signals are separately subjected to preprocessing 2 and psychoacoustic modelling 3. This is followed by a distance calculation 4, which assesses the similarity of the signals. Lastly, an MOS calculation is carried out in order to obtain a result comparable with human evaluation. According to the invention, in order to assess the transmission quality a spectral similarity value is determined which is based on calculation of the covariance of the spectra of the source signal and reception signal and division of the covariance by the standard deviations of the two said spectra.

The method makes it possible to obtain an objective assessment (speech quality prediction) while taking the human auditory process into account.

11 Claims, 7 Drawing Sheets

METHOD FOR EXECUTING AUTOMATIC EVALUATION OF TRANSMISSION QUALITY OF AUDIO SIGNALS USING SOURCE/RECEIVED-SIGNAL SPECTRAL COVARIANCE

This application is the national phase under 35 U.S.C. §371 of PCT International Application No. PCT/CH99/00269 which has an International filing date of Jun. 21, 1999, which designated the United States of America.

TECHNICAL FIELD

The invention relates to a method for making a machine-aided assessment of the transmission quality of audio signals, in particular of speech signals, spectra of a source signal to be transmitted and of a transmitted reception signal being determined in a frequency domain.

PRIOR ART

The assessment of the transmission quality of speech channels is gaining increasing importance with the growing proliferation and geographical coverage of mobile radio telephony. There is a desire for a method which is objective (i.e. not dependent on the judgment of a specific individual) and can run automatically.

Perfect transmission of speech via a telecommunications channel in the standardized 0.3–3.4 kHz frequency band gives about 98% sentence comprehension. However, the introduction of digital mobile radio networks with speech coders in the terminals can greatly impair the comprehensibility of speech. Moreover, determining the extent of the impairment presents certain difficulties.

Speech quality is a vague term compared, for example, with bit rate, echo or volume. Since customer satisfaction can be measured directly according to how well the speech is transmitted, coding methods need to be selected and optimized in relation to their speech quality. In order to assess a speech coding method, it is customary to carry out very elaborate auditory tests. The results are in this case far from reproducible and depend on the motivation of the test listeners. It is therefore desirable to have a hardware replacement which, by suitable physical measurements, measures the speech performance features which correlate as well as possible with subjectively obtained results (Mean Opinion Score, MOS).

EP 0 644 674 A2 discloses a method for assessing the transmission quality of a speech transmission path which makes it possible, at an automatic level, to obtain an assessment which correlates strongly with human perception. This means that the system can make an evaluation of the transmission quality and apply a scale as it would be used by a trained test listener. The key idea consists in using a neural network. The latter is trained using a speech sample. The end effect is that integral quality assessment takes place. The reasons for the loss of quality are not addressed.

Modern speech coding methods perform data compression and use very low bit rates. For this reason, simple known objective methods, such as for example the signal-to-noise ratio (SNR), fail.

SUMMARY OF THE INVENTION

The object of the invention is to provide a method of the type mentioned at the start, which makes it possible to obtain an objective assessment (speech quality prediction) while taking the human auditory process into account.

The way in which the object is achieved is defined by the features of claim 1. According to the invention, in order to assess the transmission quality a spectral similarity value is determined which is based on calculation of the covariance of the spectra of the source signal and reception signal and division of the covariance by the standard deviations of the two said spectra.

Tests with a range of graded speech samples and the associated auditory judgment (MOS) have shown that a very good correlation with the auditory values can be obtained on the basis of the method according to the invention. Compared with the known procedure based on a neural network, the present method has the following advantages:

- Less demand on storage and CPU resources. This is important for real-time implementation.
- No elaborate system training for using new speech samples.
- No suboptimal reference inherent in the system. The best speech quality which can be measured using this measure corresponds to that of the speech sample.

Preferably, the spectral similarity value is weighted with a factor which, as a function of the ratio between the energies of the spectra of the reception and source signals, reduces the similarity value to a greater extent when the energy of the reception signal is greater than the energy of the source signal than when the energy of the reception signal is lower than that of the source signal. In this way, extra signal content in the reception signal is more negatively weighted than missing signal content.

According to a particularly preferred embodiment, the weighting factor is also dependent on the signal energy of the reception signal. For any ratio of the energies of the spectra of reception to source signal, the similarity value is reduced commensurately to a greater extent the higher the signal energy of the reception signal is. As a result, the effect of interference in the reception signal on the similarity value is controlled as a function of the energy of the reception signal. To that end, at least two level windows are defined, one below a predetermined threshold and one above this threshold. Preferably, a plurality of, in particular three, level windows are defined above the threshold. The similarity value is reduced according to the level window in which the reception signal lies. The higher the level, the greater the reduction.

The invention can in principle be used for any audio signals. If the audio signals contain inactive phases (as is typically the case with speech signals) it is recommendable to perform the quality evaluation separately for active and inactive phases. Signal segments whose energy exceeds the predetermined threshold are assigned to the active phase, and the other segments are classified as pauses (inactive phases). The spectral similarity described above is then calculated only for the active phases.

For the inactive phases (e.g. speech pauses) a quality function can be used which falls off degressively as a function of the pause energy:

$$A^{\frac{\log 10(Epa)}{\log 10(E\max)}}$$

A is a suitably selected constant, and Emax is the greatest possible value of the pause energy.

The overall quality of the transmission (that is to say the actual transmission quality) is given by a weighted linear combination of the qualities of the active and of the inactive phases. The weighting factors depend in this case on the proportion of the total signal which the active phase represents, and specifically in a non-linear way which favours the active phase. With a proportion of e.g. 50%, the quality of the active phase may be of the order of e.g. 90%.

Pauses or interference in the pauses are thus taken into account separately and to a lesser extent than active signal pauses. This accounts for the fact that essentially no information is transmitted in pauses, but that it is nevertheless perceived as unpleasant if interference occurs in the pauses.

According to an especially preferred embodiment, the time-domain sampled values of the source and reception signals are combined in data frames which overlap one another by from a few milliseconds to a few dozen milliseconds (e.g. 16 ms). This overlap forms—at least partially—the time masking inherent in the human auditory system.

A substantially realistic reproduction of the time masking is obtained if, in addition—after the transformation to the frequency domain—the spectrum of the current frame has the attenuated spectrum of the preceding one added to it. The spectral components are in this case preferably weighted differently. Low frequency components in the preceding frame are weighted more strongly than ones with higher frequency.

It is recommendable to carry out compression of the spectral components before performing the time masking, by exponentiating them with a value $\alpha<1$ (e.g. $\alpha=0.3$). This is because if a plurality of frequencies occur at the same time in a frequency band, an over-reaction takes place in the auditory system, i.e. the total volume is perceived as greater than that of the sum of the individual frequencies. As an end effect, it means compressing the components.

A further measure for obtaining a good correlation between the assessment results of the method according to the invention and subjective human perception consists in convoluting the spectrum of a frame with an asymmetric "smearing function". This mathematical operation is applied both to the source signal and to the reception signal and before the similarity is determined.

The smearing function is, in a frequency/loudness diagram, preferably a triangle function whose left edge is steeper than its right edge.

Before the convolution, the spectra may additionally be expanded by exponentiation with a value $\epsilon>1$ (e.g. $\epsilon=4/3$). The loudness function characteristic of the human ear is thereby simulated.

The detailed description below and the set of patent claims will give further advantageous embodiments and combinations of features of the invention.

BRIEF DESCRIPTION OF THE DRAWINGS

In the drawings used to explain the illustrative embodiment.

In principle, the same parts are given the same reference numbers in the figures.

EMBODIMENTS OF THE INVENTION

A concrete illustrative embodiment will be explained in detail below with reference to the figures.

Figure 1:
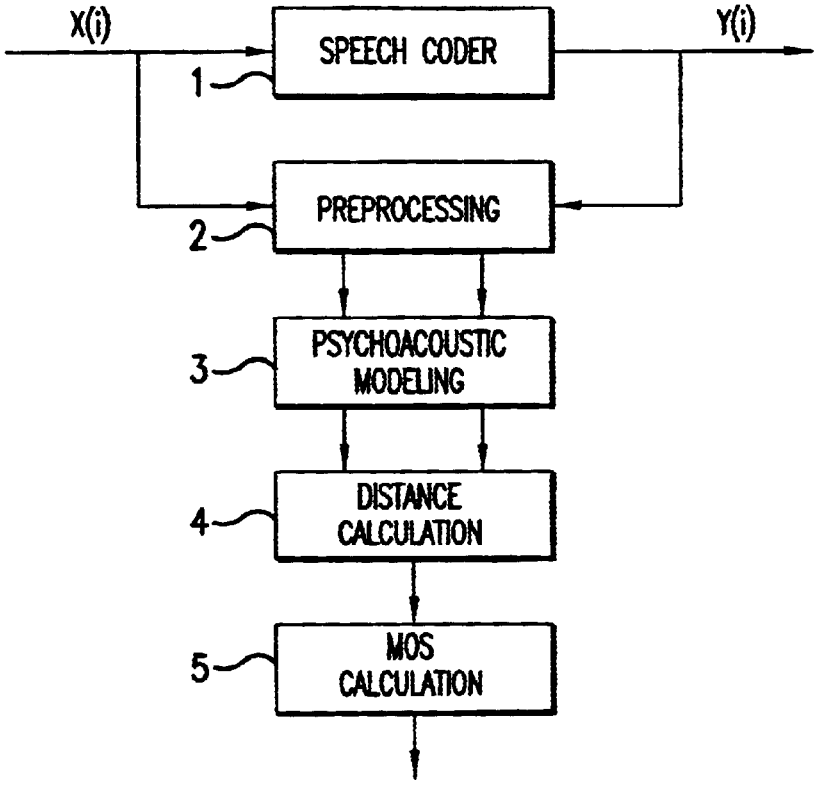
FIG. 1 is an outline block diagram to explain the principle of the processing.

FIG. 1 shows the principle of the processing. A speech sample is used as the source signal x(i). It is processed or transmitted by the speech coder 1 and converted into a reception signal y(i) (coded speech signal) The said signals are in digital form. The sampling frequency is e.g. 8 kHz and the digital quantization 16 bit. The data format is preferably PCM (without compression).

The source and reception signals are separately subjected to preprocessing 2 and psychoacoustic modelling 3. This is followed by distance calculation 4, which assesses the similarity of the signals. Lastly, an MOS calculation 5 is carried out in order to obtain a result comparable with human evaluation.

Figure 2:
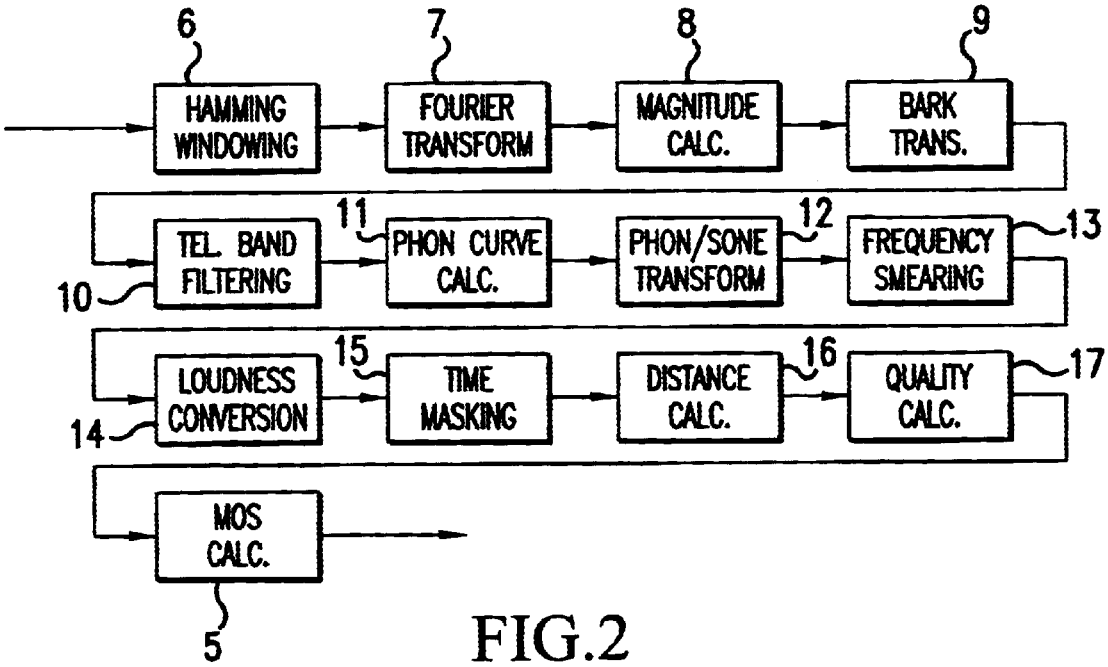
FIG. 2 is a block diagram of the individual steps of the method for performing the quality assessment.

FIG. 2 clarifies the procedures described in detail below. The source signal and the reception signal follow the same processing route. For the sake of simplicity, the process has only been drawn once. It is, however, clear that the two signals are dealt with separately until the distance measure is determined.

The source signal is based on a sentence which is selected in such a way that its phonetic frequency statistics correspond as well as possible to uttered speech. In order to prevent contextual hearing, meaningless syllables are used which are referred to as logatoms. The speech sample should have a speech level which is as constant as possible. The length of the speech sample is between 3 and 8 seconds (typically 5 seconds).

Signal conditioning: In a first step, the source signal is entered in the vector x(i) and the reception signal is entered in the vector y(i). The two signals need to be synchronized in terms of time and level. The DC component is then removed by subtracting the mean from each sample value:

$$x(i) = x(i) - \frac{1}{N}\sum_{k=1}^{N} x(k) \qquad (1)$$

$$y(i) = y(i) - \frac{1}{N}\sum_{k=1}^{N} y(k)$$

The signals are furthermore normalized to common RMS (Root Mean Square) levels because the constant gain in the signal is not taken into account:

$$x(i) = x(i) \cdot \frac{1}{\sqrt{\frac{1}{N}\sum_{k=1}^{N} x(k)^2}} \tag{2}$$

$$y(i) = y(i) \cdot \frac{1}{\sqrt{\frac{1}{N}\sum_{k=1}^{N} y(k)^2}}$$

The next step is to form the frames: both signals are divided into segments of 32 ms length (256 sample values at 8 kHz). These frames are the processing units in all the later processing steps. The frame overlap is preferably 50% (128 sample values).

Figure 3:
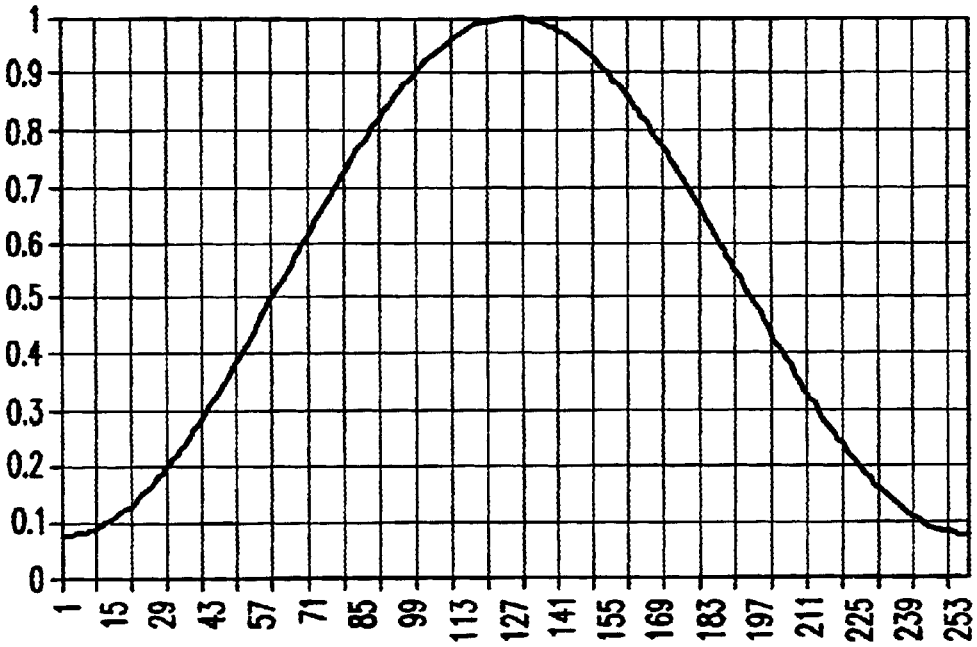
FIG. 3 shows an example of a Hamming window.
Figure 4:
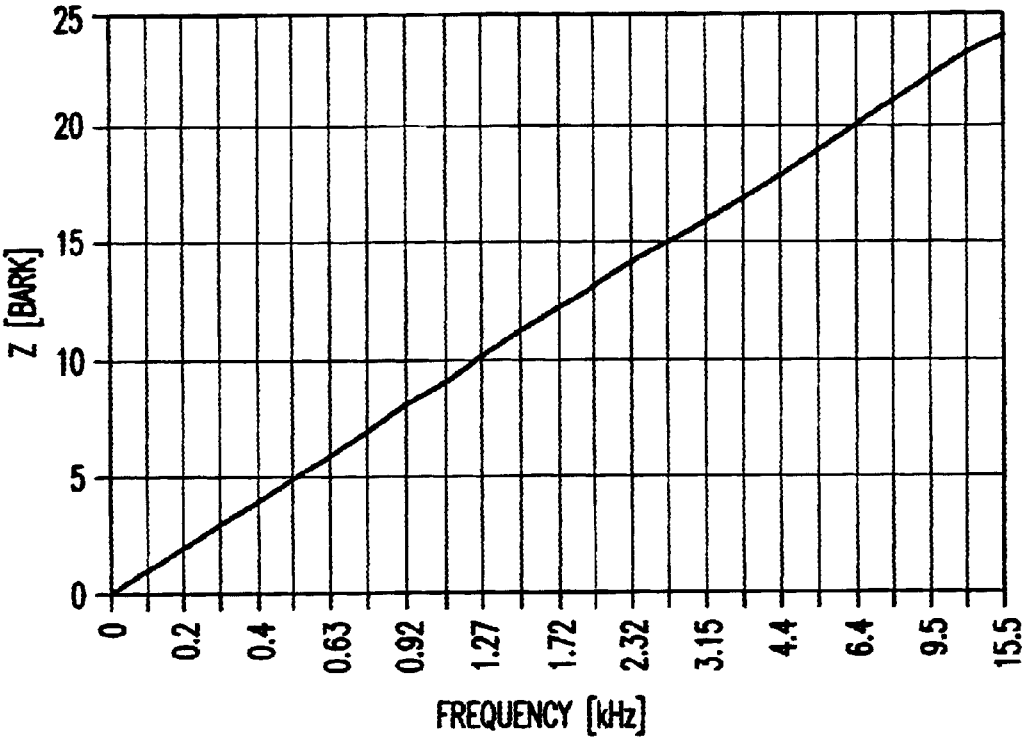
FIG. 4 shows a representation of the weighting function for calculating the frequency/tonality conversion.

This is followed by the Hamming windowing 6 (cf. FIG. 2). In a first processing step, the frame is subjected to time weighting. A so-called Hamming window (FIG. 3) is generated, by which the signal values of a frame are multiplied.

$$hamm(k) = 0.54 - 0.46 \cdot \cos\left(\frac{2\pi(k-1)}{255}\right), \quad 1 \le k \le 255 \tag{3}$$

The purpose of the windowing is to convert a temporally unlimited signal into a temporally limited signal through multiplying the temporally unlimited signal by a window function which vanishes (is equal to zero) outside a particular range.

$$x(i)=x(i)*\mathrm{hamm}(i),\ y(i)=y(i)*\mathrm{hamm}(i),\ 1 \le i \le 255 \tag{4}$$

The source signal x(t) in the time domain is now converted into the frequency domain by means of a discrete Fourier transform (FIG. 2: DFT 7). For a temporally discrete value sequence x(i) with i=0, 1, 2, . . . , N−1, which has been created by the windowing, the complex Fourier transform C(j) for the source signal x(i) when the period is N is as follows:

$$c_x(j) = \sum_{n=0}^{N-1} x(i) \cdot \exp\left(-j \cdot \frac{2\pi}{N} \cdot n \cdot j\right) \quad 0 \le j \le N-1 \tag{5}$$

The same is done for the coded signal, or reception signal y(i):

$$c_y(j) = \sum_{n=0}^{N-1} y(i) \cdot \exp\left(-j \cdot \frac{2\pi}{N} \cdot n \cdot j\right) \quad 0 \le j \le N-1 \tag{6}$$

In the next step, the magnitude of the spectrum is calculated (FIG. 2: taking the magnitude 8). The index x always denotes the source signal and y the reception signal:

$$Px_j=\sqrt{c_x(j)\cdot \mathrm{conjg}(c_x(j))},\ Py_j=\sqrt{c_y(j)\cdot \mathrm{conjg}(c_y(j))} \tag{7}$$

Division into the critical frequency bands is then carried out (FIG. 2: Bark transformation 9).

In this case, an adapted model by E. Zwicker, Psychoakustik, 1982, is used. The basilar membrane in the human ear divides the frequency spectrum into critical frequency groups. These frequency groups play an important role in the perception of loudness. At low frequencies, the frequency groups have a constant bandwidth of 100 Hz, and at frequencies above 500 Hz it increases proportionately with frequency (it is equal to about 20% of the respective midfrequency). This corresponds approximately to the properties of human hearing, which also processes the signals in frequency bands, although these bands are variable, i.e. their mid-frequency is dictated by the respective sound event.

The table below shows the relationship between tonality z, frequency f, frequency group with ΔF and FFT index. The FFT indices correspond to the FFT resolution, 256. Only the 100–4000 Hz bandwidth is of interest for the subsequent calculation.

| Z [Bark] | F(low) [Hz] | ΔF [Hz] | FFT Index |
|---|---|---|---|
| 0 | 0 | 100 | |
| 1 | 100 | 100 | 3 |
| 2 | 200 | 100 | 6 |
| 3 | 300 | 100 | 9 |
| 4 | 400 | 100 | 13 |
| 5 | 510 | 110 | 16 |
| 6 | 630 | 120 | 20 |
| 7 | 770 | 140 | 25 |
| 8 | 920 | 150 | 29 |
| 9 | 1080 | 160 | 35 |
| 10 | 1270 | 190 | 41 |
| 11 | 1480 | 210 | 47 |
| 12 | 1720 | 240 | 55 |
| 13 | 2000 | 280 | 65 |
| 14 | 2320 | 320 | 74 |
| 15 | 2700 | 380 | 86 |
| 16 | 3150 | 450 | 101 |
| 17 | 3700 | 550 | 118 |
| 18 | 4400 | 700 | |
| 19 | 5300 | 900 | |
| 20 | 6400 | 1100 | |
| 21 | 7700 | 1300 | |
| 22 | 9500 | 1800 | |
| 23 | 12000 | 2500 | |
| 24 | 15500 | 3500 | |

The window applied here represents a simplification. All frequency groups have a width ΔZ(z) of 1 Bark. The tonality scale z in Bark is calculated according to the following formula:

$$Z = 13 \cdot \arctan(0.76 \cdot f) + 3.5 \cdot \arctan\left[\left(\frac{f}{7.5}\right)^2\right], \tag{8}$$

with f in [kHz] and Z in [Bark].

A tonality difference of one Bark corresponds approximately to a 1.3 millimetre section on the basilar membrane (150 hair cells). The actual frequency/tonality conversion can be performed simply according to the following formula:

$$Px_i'[j] = \frac{1}{\Delta f_j} * \sum_{l_f[j]}^{l_t[j]} q(f) * Px_i[k], \tag{9}$$

$$Py_i'[j] = \frac{1}{\Delta f_j} * \sum_{l_f[j]}^{l_t[j]} q(f) * Py_i[k],$$

Figure 5:
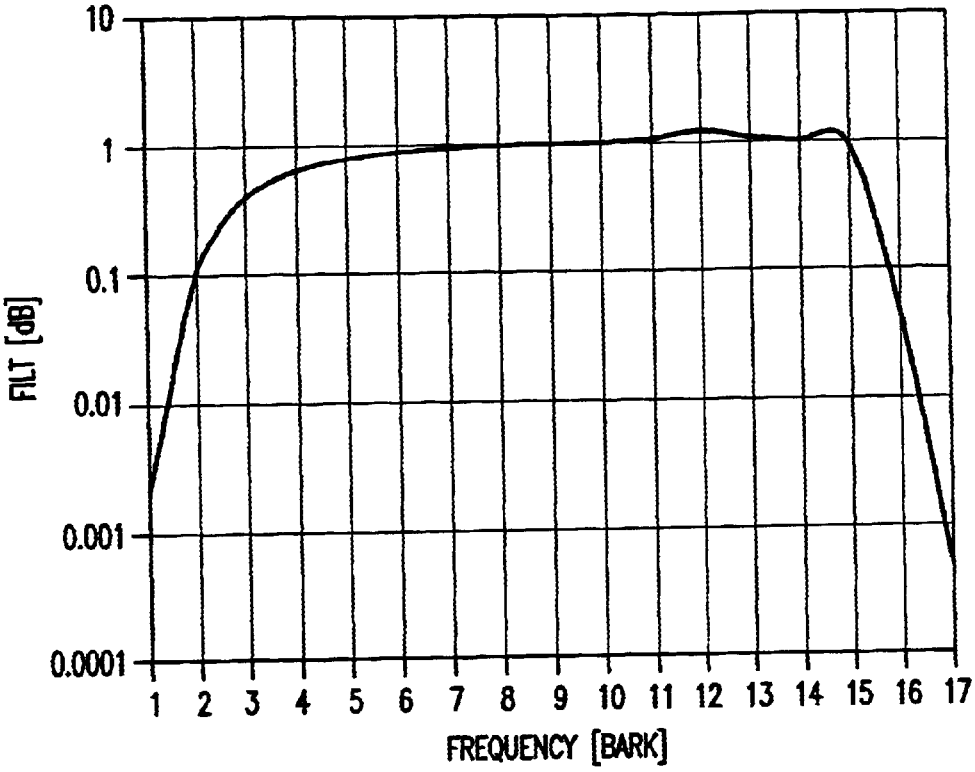
FIG. 5 shows a representation of the frequency response of a telephone filter.

$l_f[j]$ being the index of the first sample on the Hertz scale for band j and $l_t[j]$ that of the last sample. $\Delta f_j$ denotes the bandwidth of band j in Hertz. q(f) is the weighting function (FIG. 5). Since the discrete Fourier transform only gives values of the spectrum at discrete points (frequencies), the band limits each lie on such a frequency. The values at the band limits are only given half weighting in each of the neighbouring windows. The band limits are at N*8000/256 Hz.

N=3,6,9, 13, 16, 20, 25, 29, 35, 41, 47, 55, 65, 74, 86, 101, 118

For the 0.3–3.4 kHz telephony bandwidth, 17 values on the tonality scale are used, which then correspond to the input. Of the resulting 128 FFT values, the first 2, which correspond to the frequency range 0 Hz to 94 Hz, and the last 10, which correspond to the frequency range 3700 Hz to 4000 Hz, are omitted.

Both signals are then filtered with a filter whose frequency response corresponds to the reception curve of the corresponding telephone set (FIG. 2 telephone band filtering 10):

$$Pfx_i[j]=Filt[j]\cdot Px_i'[j],\ Pfy_i[j]=Filt[j]\cdot Py_i'[j] \tag{10}$$

where Filt[j] is the frequency response in band j of the frequency characteristic of the telephone set (defined according to ITU-T recomendation Annex D/P.830).

FIG. 5 graphically represents the (logarithmic) values of such a filter.

The phon curves may also optionally be calculated (FIG. 2: phon curve calculation 11). In relation to this:

The volume of any sound is defined as that level of a 1 kHz tone which, with frontal incidence on the test individual in a plane wave, causes the same volume perception as the sound to be measured (cf. E. Zwicker, Psychoakustik, 1982). Curves of equal volume for different frequencies are thus referred to. These curves are represented in FIG. 6.

Figure 6:
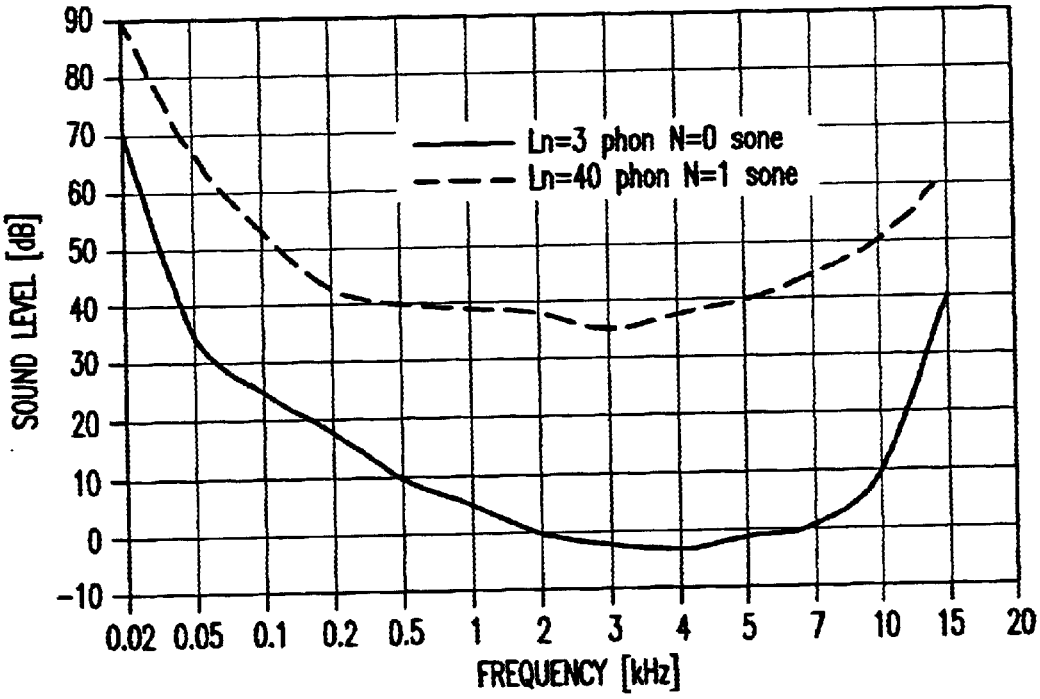
FIG. 6 shows a representation of the equal-volume curves for the two-dimensional sound field (Ln is the volume and N the loudness)

In FIG. 6 it can be seen, for example, that a 100 Hz tone at a level volume of 3 phon has a sound level of 25 dB. However, for a volume level of 40 phon, the same tone has a sound level of 50 dB. It can also be seen that, e.g. for a 100 Hz tone, the sound level must be 30 dB louder than for a 4 kHz tone in order for both to be able to generate the same loudness in the ear. An approximation is obtained in the model according to the invention through multiplying the signals Px and Py by acomplementary function.

Since human hearing overreacts when a plurality of spectral components in one band occur at the same time, i.e. the total volume is perceived as greater than the linear sum of the individual volumes, the individual spectral components are compressed. The compressed specific loudness has the unit 1 sone. In order to perform the phon/sone transformation 12 (cf. FIG. 2), in the present case the input in Bark is compressed with an exponent $\alpha$=0.3:

$$Px_i[j]=(Pfx_i[j])^{\alpha},\ Py_i[j]=(Pfy_i[j])^{\alpha} \tag{11}$$

One important aspect of the preferred illustrative embodiment is the modelling of time masking.

Figure 7:
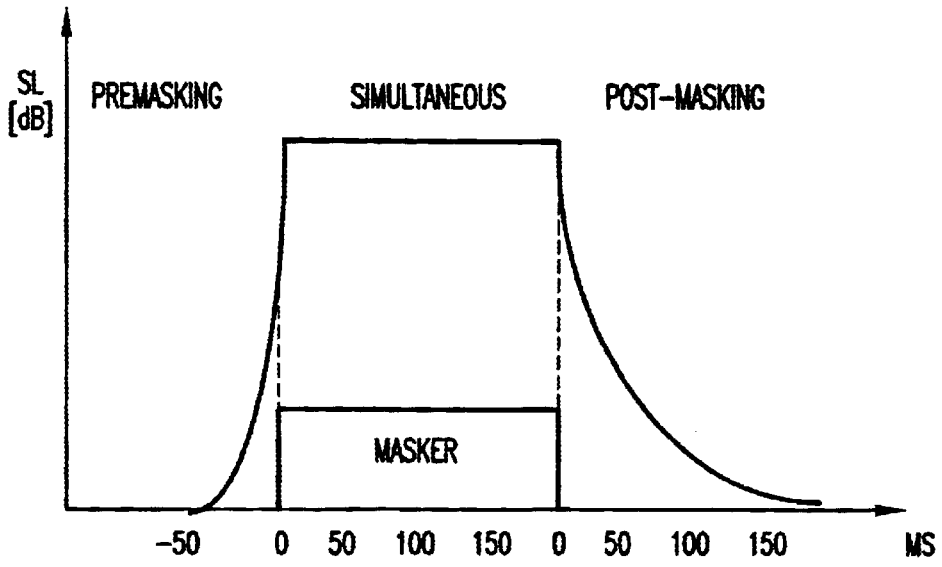
FIG. 7 shows a schematic representation of the time masking.

The human ear is incapable of discriminating between two short test sounds which arrive in close succession. FIG. 7 shows the time-dependent processes. A masker of 200 ms duration masks a short tone pulse. The time where the masker starts is denoted 0. The time is negative to the left. The second time scale starts where the masker ends. Three time ranges are shown. Premasking takes place before the masker is turned on. Immediately after this is the simultaneous masking and after the end of the masker is the post-masking phase. There is a logical explanation for the post-masking (reverberation). The premasking takes place even before the masker is turned on. Auditory perception does not occur straight away. Processing time is needed in order to generate the perception. A loud sound is given fast processing, and a soft sound at the threshold of hearing a longer processing time. The premasking lasts about 20 ms and the post-masking 100 ms. The post-masking is therefore the dominant effect. The post-masking depends on the masker duration and the spectrum of the masking sound.

A rough approximation to time masking is obtained just by the frame overlap in the signal preprocessing. For a 32 ms frame length (256 sample values and 8 kHz sampling frequency) the overlap time is 16 ms (50%). This is sufficient for medium and high frequencies. For low frequencies this masking is much longer (>120 ms). This is then implemented as addition of the attenuated spectrum of the preceding frame (FIG. 2: time masking 15). The attenuation is in this case different in each frequency band:

$$Px_i''[j] = \frac{(Px_i'[j] + Px_{i-1}'[j] * \mathrm{coeff}(j))}{1+\mathrm{coeff}(j)},\quad Py_i''[j] = \frac{(Py_i'[j] + Py_{i-1}'[j] * \mathrm{coef}f(j))}{1+\mathrm{coeff}(j)} \tag{12}$$

where coeff(j) are the weighting coefficients, which are calculated according to the following formula:

$$\mathrm{coeff}(j) = \exp\left(-\frac{\text{Frame Length}}{\dfrac{(2\cdot Fc)}{((2\cdot NoOfBarks+1)-2\cdot(j-1))\cdot\eta}}\right) \tag{13}$$

$$j = 1, 2, 3, \ldots, NoOfBarks$$

where FrameLength is the length of the frame in sample values e.g. 256, NoOfBarks is the number of Bark values within a frame (here e.g. 17). Fc is the sampling frequency and $\eta$=0.001.

Figure 13:
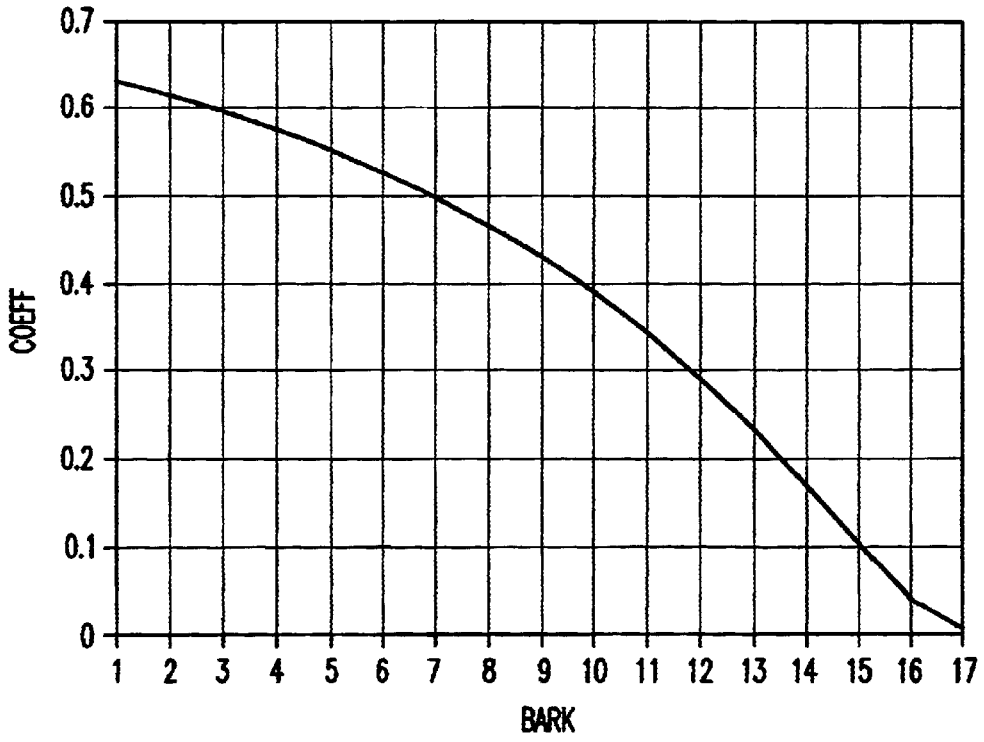
FIG. 13 shows a graphical representation of the weighting coefficients for implementing the time masking as a function of the frequency component.

The weighting coefficients for implementing the time masking as a function of the frequency component are represented by way of example in FIG. 13. It can clearly be seen that the weighting coefficients decrease with increasing Bark index (i.e with rising frequency).

Time masking is only provided here in the form of post-masking. The premasking is negligible in this context.

In a further processing phase, the spectra of the signals are "smeared" (FIG. 2: frequency smearing 13). The background for this is that the human ear is incapable of clearly discriminating two frequency components which are next to one another. The degree of frequency smearing depends on the frequencies in question, their amplitudes and other factors.

The reception variable of the ear is loudness. It indicates how much a sound to be measured is louder or softer than a standard sound. The reception variable, found in this way is referred to as ratio loudness. The sound level of a 1 kHz tone has proved useful as standard sound. The loudness 1 sone has been assigned to the 1 kHz tone with a level of 40 dB. In E. Zwicker, Psychoakustik, 1982, the following definition of the loudness function is described:

$$\mathrm{Loudness} = 2^{\frac{L_{1kHz}-40}{10}}\ [\mathrm{dB}]$$

Figure 8:
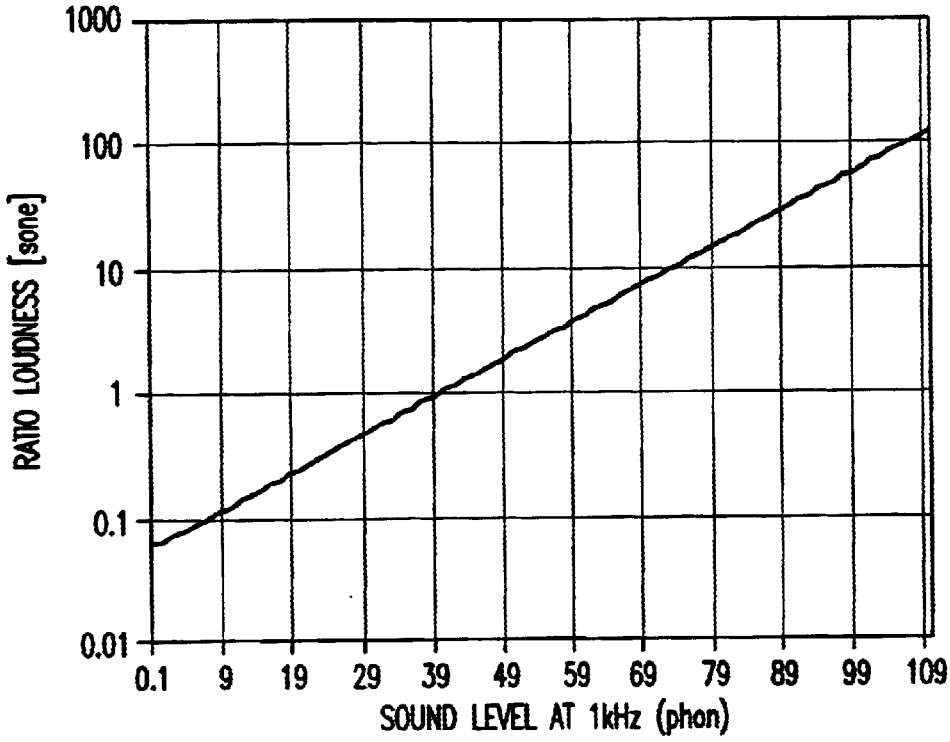
FIG. 8 shows a representation of the loudness function (sone) as a function of the sound level (phon) of a 1 kHz tone.

FIG. 8 shows a loudness function (sone) for the 1 kHz tone as a function of the sound level (phon).

In the scope of the present illustrative embodiment, this loudness function is approximated as follows:

$$Px_i'''[j]=(Px_i''[j])^{\epsilon},\ Py_i'''[j]=(Py_i''[j])^{\epsilon} \tag{14}$$

where $\epsilon$=4/3.

The spectrum is expanded at this point (FIG. 2: loudness function conversion 14).

The spectrum as it now exists is convoluted with a discrete sequence of factors (convolution). The result corresponds to smearing of the spectrum over the frequency axis. Convolution of two sequences x and y corresponds to relatively complicated convolution of the sequences in the time range or multiplication of their Fourier transforms. In the time domain, the formula is:

$$c = conv(x, y), \quad c(k) = \sum_{j=0}^{n-1} x(j) \cdot y(k+1-j), \tag{15}$$

m being the length of sequence x and n the length of sequence y. The result c has length k=m+n−1. j=max(1, k+1−n): min(k,m).

In the frequency domain:

$$\text{conv}(x,y)=FFT^{-1}(FFT(x)*FFT(y)). \tag{16}$$

x is replaced in the present example by the signal Px'" and Py'" with length 17 (m=17) and y is replaced by the smearing function Λ with length 9 (n=9). The result therefore has the length 17+9−1=25 (k=25).

$$Ex_i=\text{conv}(Px_i'''',\Lambda(f)),\ Ey_i=\text{conv}(Py_i'''',\Lambda(f)) \tag{17}$$

Figure 9:
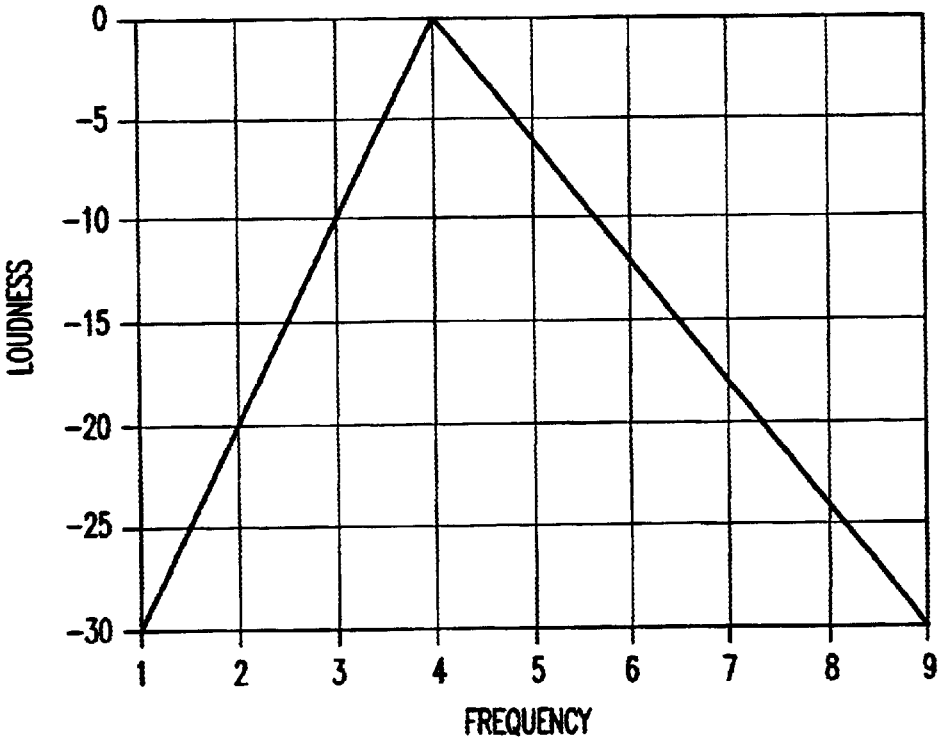
FIG. 9 shows a representation of the smearing function.

Λ(·) is the smearing function whose form is shown in FIG. 9. It is asymmetric. The left edge rises from a loudness of −30 at frequency component 1 to a loudness of 0 at frequency component 4. It then falls off again in a straight line to a loudness of −30 at frequency component 9. The smearing function is thus an asymmetric triangle function.

The psychoacoustic modelling 3 (cf. FIG. 1) is thus concluded. The quality calculation follows.

The distance between the weighted spectra of the source signal and of the reception signal is calculated as follows:

$$Q_{TOT}=\eta_{sp}\cdot Q_{sp}+\eta_{pa}\cdot Q_{pa},\ \eta_{sp}+\eta_{pa}=1 \tag{18}$$

where $Q_{sp}$ is the distance during the speech phase (active signal phase) and $Q_{pa}$ the distance in the pause phase (inactive signal phase). $\eta_{sp}$ is the speech coefficient and $\eta_{pa}$ is the pause coefficient.

The signal analysis of the source signal is firstly carried out with the aim of finding signal sequences where the speech is active. A so-called energy profile $En_{profile}$ is thus formed according to:

$$En_{profile}(i) = \begin{cases} 1, \ldots \text{if} \quad (x(i) \geq SPEECH_THR) \\ 0, \ldots \text{if} \quad (x(i) < SPEECH_THR) \end{cases}$$

SPEECH_THR is used to define the threshold value below which speech is inactive. It usually lies at +10 dB to the maximum dynamic response of the AD converter. With 16 Bit resolution, SPEECH_THR=−96.3+10=−86.3 dB. In PACE, SPEECH_THR=−80 dB.

The quality is indirectly proportional to the similarity $Q_{TOT}$ between the source and reception signals. $Q_{TOT}=1$ means that the source and reception signals are exactly the same. For $Q_{TOT}=0$ these two signals have scarcely any similarities. The speech coefficient $\eta_{sp}$ is calculated according to the following formula:

$$\eta_{sp} = -\mu\left(\frac{\mu-1}{\mu}\right)^{P_{sp}} + \mu, \quad 0 \leq P_{sp} \leq 1 \tag{19}$$

where $\mu$=1.01 and Psp is the speech proportion.

Figure 10:
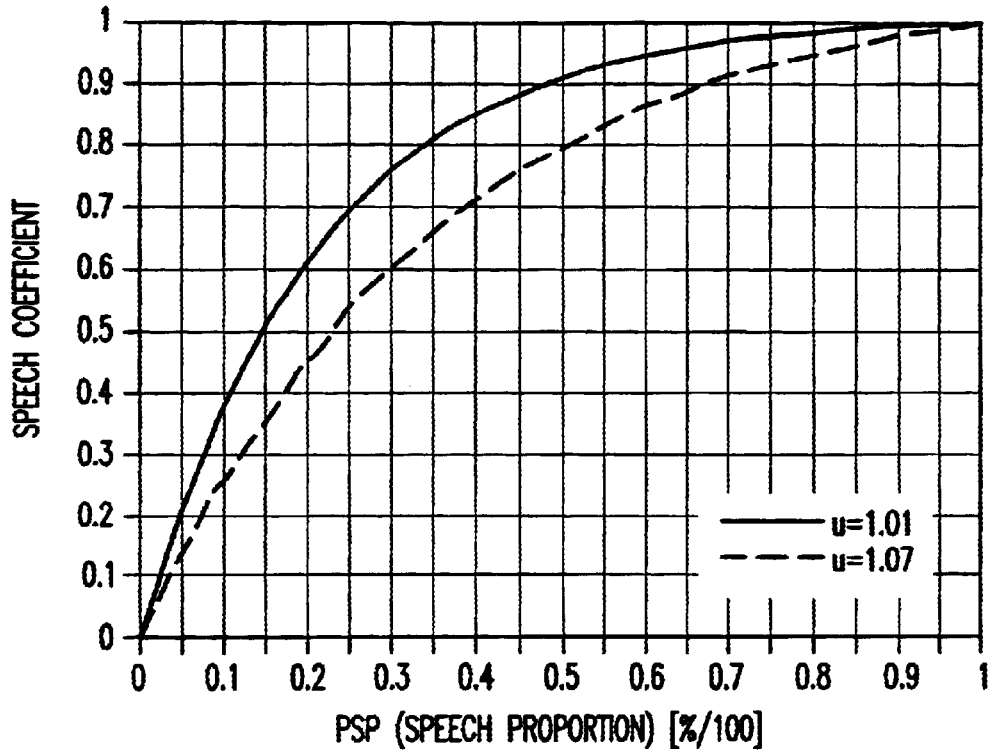
FIG. 10 shows a graphical representation of the speech coefficients in the form of a function of the proportion of speech in the source signal.

As shown in FIG. 10, the effect of the speech sequence is greater (speech coefficient greater) if the speech proportion is greater. For example, at $\mu$=1.01 and Psp=0.5 (50%), this coefficient $\eta_{sp}$=0.91. The effect of the speech sequence in the signal is thus 91% and that of the pause sequence only 9% (100−91). At $\mu$=1.07 the effect of the speech sequence is smaller (80%).

The pause coefficient is then calculated according to:

$$\eta_{pa}=1-\eta_{sp} \tag{20}$$

The quality in the pause phase is not calculated in the same way as the quality in the speech phase.

$Q_{pa}$ is the function describing the signal energy in the pause phase. When this energy increases, the value $Q_{pa}$ becomes smaller (which corresponds to the deterioration in quality):

$$Q_{pa} = -k_n \cdot \left(\frac{k_n+1}{k_n}\right)^{\frac{\log10(E_{pa})}{\log10(E_{\max})}} + k_n + 1 + m \tag{21}$$

$k_n$ is a predefined constant and here has the value 0.01. $E_{pa}$ is the RMS signal energy in the pause phase for the reception signal. Only when this energy is greater than the RMS signal energy of the pause phase in the source signal does it have an effect on the $Q_{pa}$ value. Thus, $E_{pa}$=max($Eref_{pa}$,$E_{pa}$). The smallest $E_{pa}$ is 2. $E_{max}$ is the maximum RMS signal energy for given digital resolution (for 16 bit resolution, $E_{max}$= 32768). The value m in formula (21) is the correction factor for $E_{pa}$=2, so that then $Q_{pa}$=1. This correction factor is calculated thus:

$$m = k_n \cdot \left(\frac{k_n+1}{k_n}\right)^{\frac{\log10(E_{\min})}{\log10(E_{\max})}} - k_n \tag{22}$$

For $E_{max}$=32768, $E_{min}$=2 und $k_n$=0.01 the value of m=0.003602. The basis kn*(kn+1/kn) can essentially be regarded as a suitably selected constant A.

Figure 11:
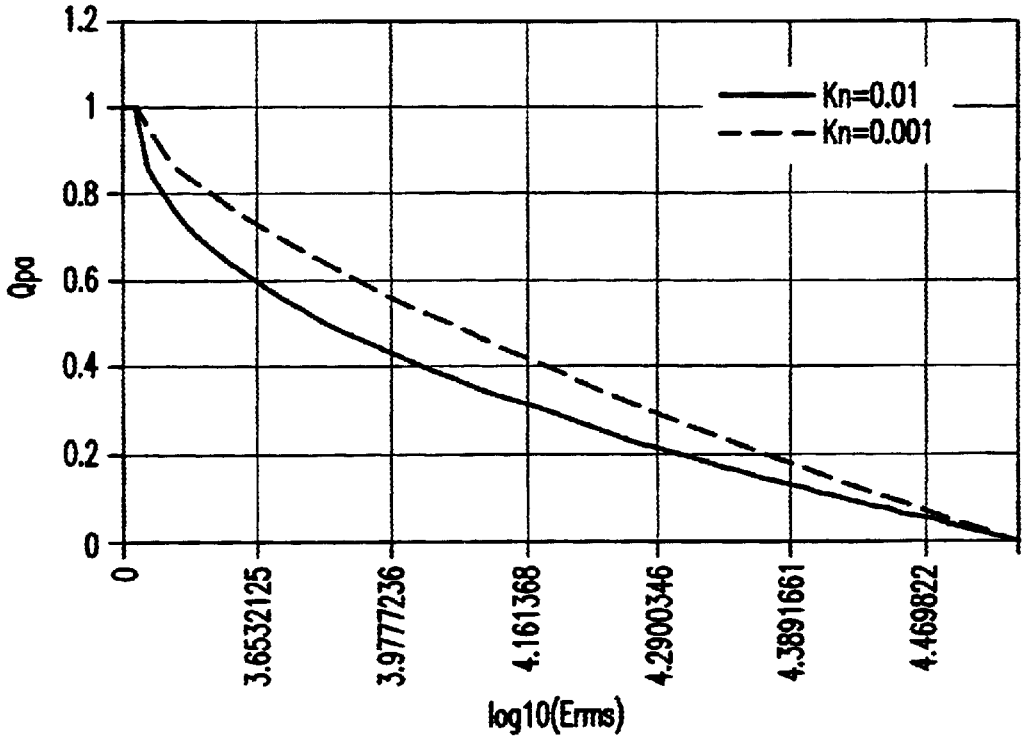
FIG. 11 shows a graphical representation of the quality in the pause phase in the form of a function of the speech energy in the pause phase.

FIG. 11 represents the relationship between the RMS energy of the signal in the pause phase and $Q_{pa}$.

The quality of the speech phase is determined by the "distance" between the spectra of the source and reception signals.

First, four level windows are defined. Window No. 1 extends from −96.3 dB to −70 dB, window No. 2 from −71 dB to −46 dB, window No. 3 from −46 dB to −26 dB and window No. 4 from −26 dB to 0 dB. Signals whose levels lie in the first window are interpreted as a pause and are not included in the calculation of $Q_{sp}$. The subdivision into four level windows provides multiple resolution. Similar procedures take place in the human ear. It is thus possible to control the effect of interference in the signal as a function of its energy. Window four, which corresponds to the highest energy, is given the maximum weighting.

The distance between the spectrum of the source signal and that of the reception signal in the speech phase for speech frame k and level window i $Q_{sp}$(i, k), is calculated in the following way:

$$Q_{sp}(i,k)=\frac{G_{(i,k)}\cdot n\cdot\sum_{j=1}^{n}(Ex(k)_j-\overline{Ex(k)})\cdot(Ey(k)_j-\overline{Ey(k)})}{\sqrt{n\cdot\sum_{j=1}^{n}Ex(k)_j^2-\left(\sum_{j=1}^{n}Ex(k)_j\right)^2}\cdot\sqrt{n\cdot\sum_{j=1}^{n}Ey(k)_j^2-\left(\sum_{j=1}^{n}Ey(k)_j\right)^2}},\tag{23}$$

where Ex(k) is the spectrum of the source signal and Ey(k) the spectrum of the reception signal in frame k. n denotes the spectral resolution of a frame. n corresponds to the number of Bark values in a time frame (e.g. 17). The mean spectrum in frame k is denoted $\overline{E(k)}$. $G_{i,k}$ is the frame- and window-dependent gain constant whose value is dependent on the energy ratio $$\frac{Py}{Px}.$$

Figure 12:
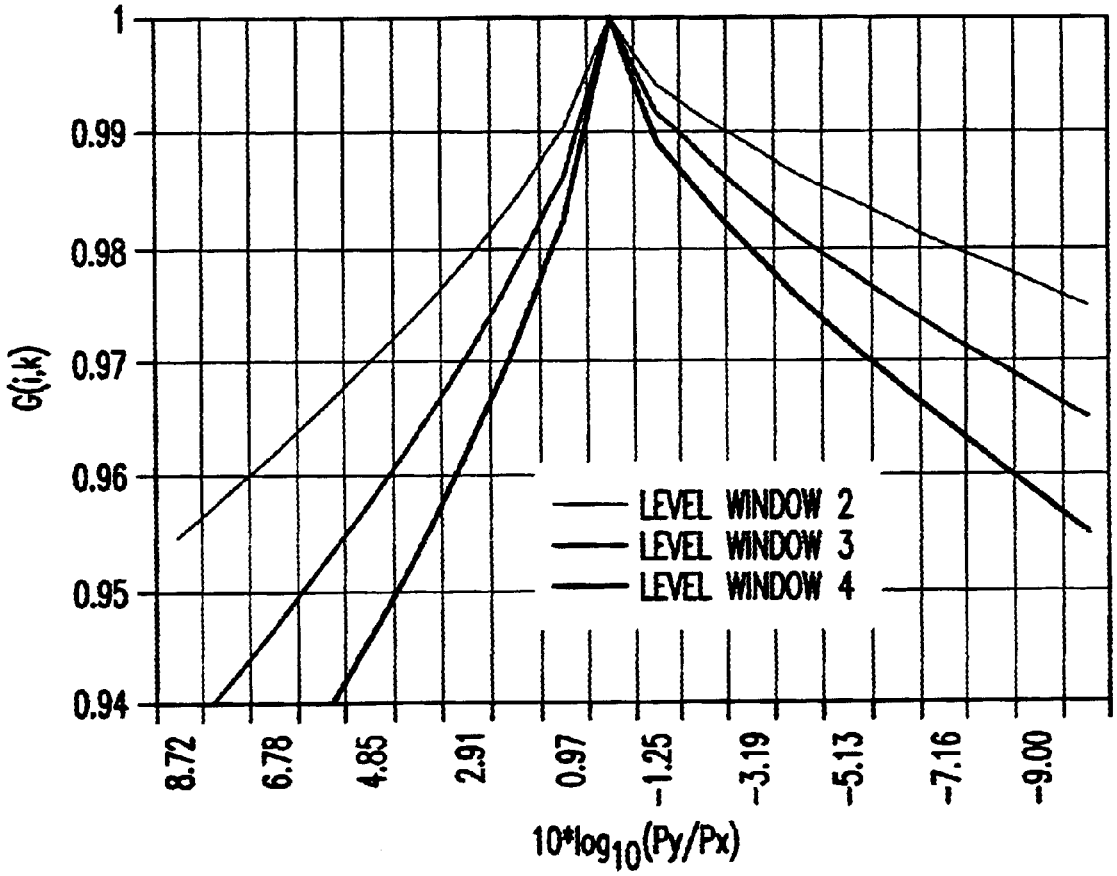
FIG. 12 shows a graphical representation of the gain constant in the form of a function of the energy ratio.

A graphical representation of the $G_{i,k}$ value in the form of a function of the energy ratio is represented in FIG. 12.

When this gain is equal to 1 (energy in the reception signal equals the energy in the source signal), $G_{i,k}=1$ as well.

When the energy in the reception signal is equal to the energy in the source signal, $G_{i,k}$ is equal to 1. This has no effect on $Q_{sp}$. All other values lead to smaller $G_{i,k}$ or $Q_{sp}$, which corresponds to a greater distance from the source signal (quality of the reception signal lower). When the energy of the reception signal is greater than that of the source signal:>1, the gain constant behaves according to the equation:

$$G=1-\varepsilon_{HI}\cdot\left(\log_{10}\left(\frac{Py}{Px}\right)\right)^{0.7}.$$

When this energy ratio $$\left(\frac{Py}{Px}\right)<1,$$

then:

$$G=1-\varepsilon_{LO}\cdot\left(\log_{10}\left(\frac{Py}{Px}\right)\right)^{0.7}.$$

The values of $\epsilon_{HI}$ and $\epsilon_{LO}$ for the individual level windows can be found in the table below.

| Window No. i | $\epsilon_{HI}$ | $\epsilon_{LO}$ | θ | $\gamma_{SD}$ |
|---|---|---|---|---|
| 2 | 0.05 | 0.025 | 0.15 | 0.1 |
| 3 | 0.07 | 0.035 | 0.25 | 0.3 |
| 4 | 0.09 | 0.045 | 0.6 | 0.6 |

The described gain constant causes extra content in the reception signal to increase the distance to a greater extent than missing content.

From formula (23) it can be seen that the numerator corresponds to the covariance function and the denominator corresponds to the product of two standard deviations. Thus, for the k-th frame a and level window i, the distance is equal to:

$$Q_{sp}(i,k)=G_{(i,k)}\cdot\frac{Cov_k(Px,Py)}{\sigma_x(k)\cdot\sigma_y(k)}\tag{24}$$

The values θ and $\gamma_{SD}$ for each level window, which can likewise be seen from the table above, are needed for converting the individual $Q_{sp}(i,k)$ into a single distance measure $Q_{sp}$.

As a function of the content of the signal, three $Q_{sp}(i)$ vectors are obtained whose lengths may be different. In a first approximation, the mean for the respective level window i is calculated as:

$$Q_i=\frac{1}{N}\sum_{j=0}^{N}Q_{sp}(i)_j,\tag{25}$$

N is the length of the $Q_{sp}(i)$ vector, or the number of speech frames for the respective speech window i.

The standard deviation $SD_i$ of the $Q_{sp}(i)$ vector is then calculated as:

$$SD_i=\sqrt{\frac{\sum Q_{sp}(i)-(\sum Q_{sp}(i))^2}{N}},\tag{26}$$

SD describes the distribution of the interference in the coded signal. For burst-like noise, e.g. pulse noise, the SD value is relatively large, whereas it is small for uniformly distributed noise. The human ear also perceives a pulselike distortion more strongly. A typical case is formed by analogue speech transmission networks such as e.g. AMPS.

The effect of how well the signal is distributed is therefore implemented in the following way:

$$Ksd(i)=1+SD_i\cdot\gamma_{SD}(i),\tag{27}$$

with the following definitions $Ksd(i)=1$, for $Ksd(i)>1$ and $Ksd(i)=0$, for $Ksd(i)<0$.

and lastly $$Qsd_i=Ksd(i)*Q_i,\tag{28}$$

The quality of the speech phase, $Q_{sp}$, is then calculated as the weighted sum of the individual window qualities, according to:

$$Q_{sp}=\sum_{i=2}^{4}U_i\cdot Qsd_i,\tag{29}$$

The weighting factors $U_i$ are determined using $$U_i=\eta_{sp}\cdot p_i,\tag{30}$$

$\eta_{sp}$ being the speech coefficient according to formula 19 and $p_i$ corresponding to the weighted degree of membership of the signal to window i and being calculated using $$p_i=\frac{O_i}{\sum_{l=2}^{4}O_i}\quad\text{with}$$

-continued $$O_i = \frac{N_i}{N_{sp}} \cdot \theta_i.$$

$N_i$ is the number of speech frames in window i, $N_{sp}$ is the total number of speech frames and the sum of all θs is always equal to 1:

$$\sum_{i=2}^{4} \theta_i = 1.$$

I.e.: the greater the ratio $$\frac{N_i}{N_{sp}}$$

or the $\theta_i$ are, the more meaning the interference in the respective speech frame has.

Of course, for a gain constant independent of signal level, the values of $\epsilon_{HI}^{-}$, $\epsilon_{LO}$, θ and $\gamma_{SD}$ can also be chosen as equal for each window.

FIG. 2 represents the corresponding processing segment by the distance measure calculation 16. The quality calculation 17 establishes the value Qtot (formula 18).

Last of all comes the MOS calculation 5. This conversion is needed in order to be able to represent $Q_{TOT}$ on the correct quality scale. The quality scale with MOS units is defined in ITU T P.800 "Method for subjective determination of transmission quality", 08/96. A statistically significant number of measurements are taken. All the measured values are then represented as individual points in a diagram. A trend curve is then drawn in the form of a second-order polynom through all the points.

$$MOS_o = a \cdot (MOS_{PACE})^2 + b \cdot MOS_{PACE} + c \quad (31)$$

This MOSo value (MOS objective) now corresponds to the predetermined MOS value. In the best case, the two values are equal.

The described method can be implemented with dedicated hardware and/or with software. The formulae can be programmed without difficulty. The processing of the source signal is performed in advance, and only the results of the preprocessing and psychoacoustic modelling are stored. The reception signal can e.g. be processed on line. In order to perform the distance calculation on the signal spectra, recourse is made to the corresponding stored values of the source signal.

The method according to the invention was tested with various speech samples under a variety of conditions. The length of the sample varied between 4 and 16 seconds.

The following speech transmissions were tested in a real network:

normal ISDN connection.

GSM-FR <–> ISDN and GSM-FR alone.

various transmissions via DCME devices with ADPCM (G.726) or LD-CELP (G.728) codecs.

All the connections were run with different speech levels. The simulation included:

CDMA Codec (IS-95) with various bit error rates.

TDMA Codec (IS-54 and IS-641) with echo canceller switched on.

Additive background noise and various frequency responses.

Each test consists of a series of evaluated speech samples and the associated auditory judgment (MOS). The correlation obtained between the method according to the invention and the auditory values was very high.

In summary, it may be stated that the modelling of the time masking, the modelling of the frequency masking, the described model for the distance calculation, the modelling of the distance in the pause phase and the modelling of the effect of the energy ratio on the quality provided a versatile assessment system correlating very well with subjective perception.

What is claimed is:

1. Method for making a machine-aided assessment of the transmission quality of audio signals, in particular of speech signals, spectra of a source signal to be transmitted and of a transmitted reception signal being determined in a frequency domain, characterized in that, in order to assess the transmission quality, a spectral similarity value is determined by dividing the covariance of the spectra of the source signal and of the reception signal by the product of the standard deviations of the two spectra and is used in the calculation of transmission quality.

2. Method according to claim 1, characterized in that the spectral similarity value is weighted with a gain factor which, as a function of a ratio between the energies of the reception and source signals, reduces the similarity value to a greater extent when the energy of the reception signal is greater than the energy in the source signal than when the energy of the reception signal is lower than the energy in the source signal.

3. Method according to claim 2, characterized in that the gain factor reduces the similarity value as a function of the energy of the reception signal to a greater extent the higher the energy of the reception signal is.

4. Method according to one of claims 1 to 3, characterized in that inactive phases are extracted from the source and reception signals, and in that the spectral similarity value is determined only for the remaining active phases.

5. Method according to claim 4, characterized in that, for the inactive phases, a quality value is determined which, as a function of the energy Ep in the inactive phases, essentially has the following characteristic:

$$A^{\frac{\log 10(Epa)}{\log 10(E\max)}}.$$

6. Method according to claim 4, characterized in that the transmission quality is calculated by a weighted linear combination of the similarity value of the active phase and the quality value of the inactive phase.

7. Method according to claim 1, characterized in that before their transformation to the frequency domain, the source and reception signals are respectively divided into time frames in such a way that successive frames overlap to a substantial extent of up to 50%.

8. Method according to claim 7, characterized in that, in order to perform time masking, the spectrum of a frame has the attenuated spectrum of the preceding frame added to it in each case.

9. Method according to claim 8, characterized in that, before performing time masking, the components of the spectra are compressed by exponentiation with a value $\alpha<1$.

10. Method according to claim 1, characterized in that the spectra of the source and reception signal are each convoluted with a frequency-asymmetric smearing function before determining the similarity value.

11. Method according to claim 10, characterized in that the components of the spectra are expanded by exponentiation with a value $\epsilon>1$ before the convolution.

* * * * *